United States Patent [19]

Szigeti

[11] 4,387,998

[45] Jun. 14, 1983

[54] DEVICE FOR MIXING AND DISTRIBUTING A TWO-CONSTITUENT PRODUCT

[76] Inventor: Elémer Szigeti, 1, Place Eugène Mô, Nice (Alpes Maritimes), France

[21] Appl. No.: 265,511

[22] Filed: May 20, 1981

[30] Foreign Application Priority Data

Dec. 12, 1980 [FR] France ..... 80 26087

[51] Int. Cl.[3] ..... B01F 13/00; B65D 25/08

[52] U.S. Cl. ..... 366/130; 206/222; 220/20.5

[58] Field of Search ..... 366/129, 130; 206/219–222; 220/20.5

[56] References Cited

U.S. PATENT DOCUMENTS

| | | | |
|---|---|---|---|
| 3,139,180 | 6/1964 | Kobernick | 206/220 |
| 3,451,540 | 6/1969 | Kulischenko | 206/220 |
| 3,917,062 | 11/1975 | Winters | 206/219 |
| 4,294,351 | 10/1981 | Cheetham | 206/222 |

*Primary Examiner*—Philip R. Coe
*Assistant Examiner*—Joseph M. Pitko
*Attorney, Agent, or Firm*—Karl W. Flocks

[57] ABSTRACT

A mixing and distributing device for a two constituent product, notably for the formation of a foam in situ, comprises a first and a second interfitted compartment having an inner end and an outer end separated by a web. Means are provided for tearing said web under the effect of the axial approach movement of said compartments through their inner ends, the walls of the latter including complementary threads designed to cooperate to bring about said approach. Each compartment comprises a solid portion and a hollow portion in the form of a substantially semicylindrical trough bounded by a longitudinal surface, the first compartment comprising a removable plug at its outer end and said web at its inner end, said second compartment being closed at its outer end and provided at its other end, on the one hand, with a peripheral projection forming a cutting-out knife for the web and, on the other hand, an axial tit projecting with respect to the inner end of its solid portion.

5 Claims, 3 Drawing Figures

DEVICE FOR MIXING AND DISTRIBUTING A TWO-CONSTITUENT PRODUCT

BACKGROUND OF THE INVENTION

The present invention relates to a device for mixing and distributing a two-constituent product, intended notably to form a foam in situ from two suitable constituents, such as a polyurethane foam.

Applicant has already described in his U.S. patent Ser. No. 60,517, filed July 25, 1979, a process for stabilizing the texture of a plastic substance, to notably overcome the unpleasant or dangerous character of the presence of slippery substances, in particular of animal excrements, on a pedestrian passage-way. According to this process, it is possible to coat the substance in the plastic condition with a fast-hardening and non-toxic product, by means of which said substance is rendered inert and rigid, hence easily removed from the passage-way. Among the coating products, there are provided in particular, synthetic resins, polyurethane foam revealing itself to be perfectly adapted to this use, by formation in situ. For the latter, Applicant has also described in his aforesaid U.S. application, a flow device for the product comprising two individual cylindrical compartments containing respectively each constituent, arranged in extension of one another and separated by at least one web, itself tearable by means of a perforating pin acting on bringing together of the two compartments through threads cooperating for this purpose.

It is however indispensable that the web, after tearing, should ensure a free mutual passage for the two constituents so that they can mix. Now, in the case of a perforated web, the passage cross-section remains sometimes insufficient and does not result in complete reaction between the two measured amounts of the two constituents. Other trials have consisted of carrying out peripheral cutting-out of the web but, in this case, the cut-out portion can form a pastille, which, although free, still forms an obstacle to the free passage and mixing of the constituents.

SUMMARY OF THE INVENTION

It is an object of the present invention to overcome these drawbacks, by providing a mixing and distributing device, of the above type, in which the cut-out web cannot interfere in any case, and in addition, the safety on transportation in inactive position is reinforced.

According to the invention, each compartment of the device comprises a solid portion and a hollow portion in the form of a substantially hemi-cylindrical trough, bounded by a longitudinal surface, the first compartment including a removable plug at its outer end and a web at its inner end, the second compartment being closed at its outer end and provided at its other end, on the one hand, with a peripheral projection forming a web-cutting knife and, on the other hand, with an axial tit projecting with respect to the inner end of the full portion.

According to another feature, the inner ends of the wall of the two compartments include complementary threads whose pitch is such that, by rotation by about a half turn of one compartment with respect to the other, there result, on the one hand, a cutting out of the web over the inner end of the hemi-cylindrical trough of the first compartment and, on the other hand, the arrangement of the troughs of two compartments in extension of one another.

BRIEF DESCRIPTION OF THE DRAWINGS

Other features and advantages of the invention will emerge more clearly from the description which follows, given with reference to the accompanying drawings in which.

In these drawings, the same reference numerals denote the same elements.

DESCRIPTION OF PREFERRED EMBODIMENTS

Figure 1:
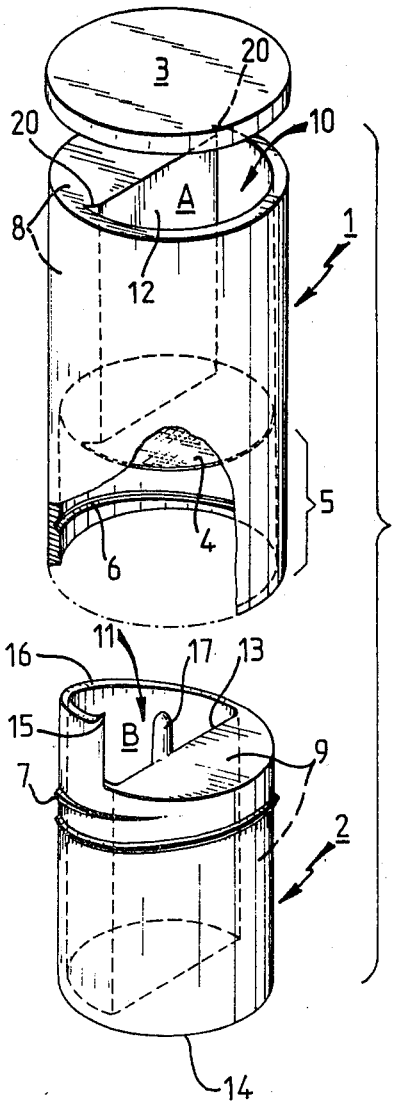
FIG. 1 shows an exploded diagrammatic view, in perspective, of an embodiment of a device according to the invention.

Referring to FIG. 1, the embodiment of the device according to the invention comprises two cylindrical compartments 1 and 2 interfitted onto one another and arranged in extension of one another. Each of these compartments is intended to contain the two respective constituents A and B of the product to be formed and distributed in situ. The first compartment 1 has its outer end open, provided with a removable plug 3, whilst its inner end is closed by a transverse web 4. In addition, the wall of the compartment 1 is extended, beyond the web 4, by a skirt 5 provided with a thread 6 cooperating with a thread 7 located on the periphery of the compartment 2.

As mentioned above, each compartment comprises a solid portion 8, 9 respectively, and a hollow portion 10, 11 respectively, in the form of a substantially hemi-cylindrical trough bounded by a plane or slightly curved longitudinal surface 12 13 respectively, of the corresponding solid portion. The term "solid portion" must be understood to comprise a closed portion not intended to contain a product A or B, although, materially it could itself be hollow but bounded on all its faces by solid walls.

The outer end of the second compartment 2 is closed by a bottom 14, whilst its inner end includes a projection 15 at its periphery, forming a cutting-out knife for the web 4, as will be explained below. The projection 15 is advantageously constituted by the edge of a helical ramp 16 formed on the wall of the inner end of the compartment 2, beyond the solid portion 9. The longitudinal surface 13 of said solid portion 9 comprises an attached axial tit 17 with a rounded end, projecting with respect to the inner end of the solid portion 9.

Figure 2:
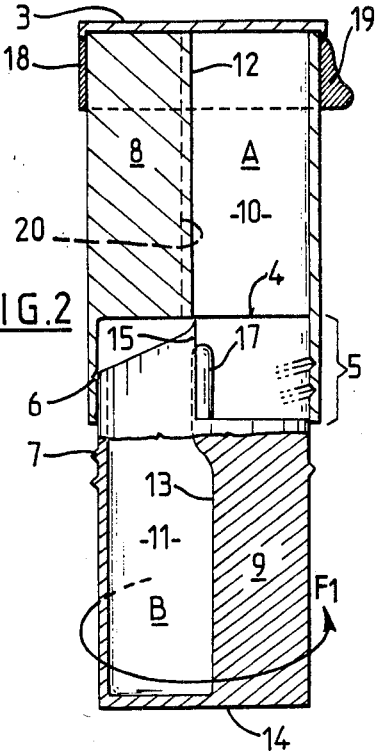
FIGS. 2 and 3 show diagrammatic views in longitudinal section of the embodiment of the device of FIG. 1, respectively in inactive position and in working position, illustrating the operation of said device.

Referring to FIG. 2, the device, in resting position, has a solid portion 8 or 9, facing a hollow portion 10 or 11, which reinforces the safety on transportation in the exceptional case where the web 4 could have a defect, thus preventing the premature mixing of the constituents A and B.

Figure 3:
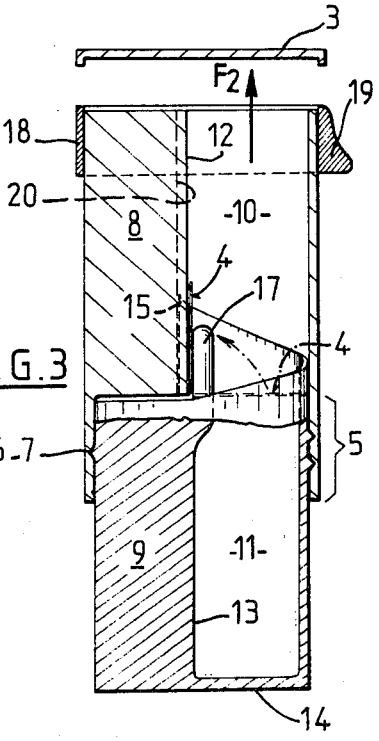

As indicated above, the threads 6 and 7 have a pitch such that, by rotation by about one half turn along F1 of one compartment with respect to the other to bring the latter together, there results, on the one hand, the cutting-out of the web by the knife 15 along the periphery of the inner end of the trough 10 of the compartment 1 and, on the other hand, the arrangement of the troughs 10 and 11 of the two compartments in extension of one another, in order to place the two constituents A and B in contact. This configuration, in working position, is represented in FIG. 3. The approach movement of the compartments, of cutting-out the web and of alignment of the troughs is completed by the progressive detachment of the cut-out portion of the web, supported on the ramp 16. Simultaneously, the rounded end of the axial tit 17 pushes back said cut-out portion, which is inserted between said tit and the longitudinal face 12 of the compartment 1 on which it is flattened at the end of rotation. Under these conditions, the free passage of the constituents A and B is ensured and their mixing is effected under optimum conditions, the mixed product, for example polyurethane foam, being expelled from the latter at F2 at the open outer end of the compartment 1 pushing back the plug 3 as required. It should be noted that the latter, although shown in the form of an enveloping cover, can of course include a body inserted in the outer end of the compartment 1, with corresponding shortening of the solid portion 8. In addition, it is possible to provide a rapid expulsion means for the plug at the moment of use, in the form, for example, of a sleeve 18 which may or may not be fastened to the plug 3 and provided with a projection 19 enabling the opening by one finger when the device is held in the hand this avoiding any contact with the product. Advantageously, compartment 2 may be realized in a deformable material in order to push out the final product if necessary.

Advantageously also, it is possible to provide a cleft 20 along the lateral edges, of the longitudinal surfaces, in particular of the surface 12, enabling the insertion of the knife 15 at the end of the cutting out of the web 4. The knife 15 also assuming support against this cleft ensures at the stroke end the blocking of the opening in working position, the two troughs 10 11 being aligned under the best conditions.

It is of course to be well understood that the present invention has only been described and illustrated by way of explanatory but entirely non-limiting example and that it would be possible to introduce therein any useful modification, notably within the field of technical equivalents, without departing from the scope of the invention.

What is claimed is:

1. Mixing and distributing device for a two-constituent product, notably for the formation of a foam in situ, comprising, first and second interfitted compartments each having an inner end and an outer end, the inner ends facing each other and being separated by a web and means for tearing said web under the action of the axial approach movement of said compartments through their inner ends, the walls of the inner ends including complementary threads designed to cooperate to bring about said approach, each of said compartments comprising a solid portion and a hollow portion in the form of a substantially semi-cylindrical trough bounded by a longitudinal surface, the first compartment comprising a removable plug at its outer end and said web at its inner end, said second compartment being closed at its outer end and provided at its inner end with both a peripheral projection forming a cutting-out knife for the web and an axial tit projecting with respect to the inner end of its solid portion.

2. Device according to claim 1, in which, the threads of said two compartments have a pitch such that, by rotation by about a half turn of one compartment with respect to the other, there results both the cutting-out of the web on the inner end of the semi-cylindrical trough of the first compartment and the arranging of the troughs of the two compartments in extension of one another.

3. Device according to claim 1, wherein said axial projecting tit has a rounded end designed to flatten the cut-out portion of the web on the longitudinal surface of the solid portion of the first compartment progressively with the cutting-out of said web.

4. Device according to claim 1, in which in the resting position, a solid portion of one compartment is arranged facing a hollow portion of the other compartment.

5. Device according to claim 1, in which in the working position, the hollow portions of the two compartments are arranged in extension of one another, the cut-out web being flattened on the longitudinal surface of the solid portion of the first compartment by insertion between said surface and said axial tit.

* * * * *